US010539356B2

(12) United States Patent
Tao et al.

(10) Patent No.: US 10,539,356 B2
(45) Date of Patent: Jan. 21, 2020

(54) SINTERED HEAT TUBE AND SEMICONDUCTOR COOLING REFRIGERATOR PROVIDED WITH SAME

(71) Applicant: QINGDAO HAIER JOINT STOCK CO., LTD., Qingdao, Shandong Province (CN)

(72) Inventors: Haibo Tao, Qingdao (CN); Kui Zhang, Qingdao (CN); Jianru Liu, Qingdao (CN); Peng Li, Qingdao (CN); Chunyang Li, Qingdao (CN); Feifei Qi, Qingdao (CN); Lisheng Ji, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 92 days.

(21) Appl. No.: 15/521,894

(22) PCT Filed: Sep. 29, 2015

(86) PCT No.: PCT/CN2015/091096
§ 371 (c)(1),
(2) Date: Apr. 25, 2017

(87) PCT Pub. No.: WO2016/123997
PCT Pub. Date: Aug. 11, 2016

(65) Prior Publication Data

US 2017/0328622 A1 Nov. 16, 2017

(30) Foreign Application Priority Data

Feb. 3, 2015 (CN) ..... 2015 1 0056261

(51) Int. Cl.
*F28D 15/02* (2006.01)
*F28D 15/04* (2006.01)
(Continued)

(52) U.S. Cl.
CPC ..... *F25D 3/005* (2013.01); *F25B 39/04* (2013.01); *F25D 11/00* (2013.01);
(Continued)

(58) Field of Classification Search
CPC .. F28D 15/0266; F28D 15/04; F28D 15/0233; F28D 15/046; F28D 15/02
See application file for complete search history.

(56) References Cited

U.S. PATENT DOCUMENTS 5,522,455 A 6/1996 Brown et al.
6,899,165 B1 * 5/2005 Wu ..... F28D 15/0233 165/104.21
(Continued)

FOREIGN PATENT DOCUMENTS

CN 201053839 Y 4/2008
CN 102510990 A 6/2012
(Continued)

*Primary Examiner* — Leonard R Leo
(74) *Attorney, Agent, or Firm* — Cheng-Ju Chiang

(57) ABSTRACT

A sintered heat tube and a semiconductor cooling refrigerator having the same, the sintered heat tube comprises: a main tube segment with its both ends closed, and a manifold tube segment/manifold tube segments extending from one or more portions of one side of the main tube segment (respectively), wherein a work chamber of each manifold tube segment communicates with that of the main tube segment. In the sintered heat tube and the semiconductor cooling refrigerator having the sintered heat tube of the present invention, as the sintered heat tube includes manifold tube segments, the sintered heat tube of the present invention greatly improves the heat radiating or cold transferring efficiency. The sintered heat tube is particularly suitable for heat radiation of heat sources of a high heat flow density such as semiconductor cooling plates.

10 Claims, 5 Drawing Sheets

(51) Int. Cl.
*F25D 3/00* (2006.01)
*F25D 11/00* (2006.01)
*F25B 39/04* (2006.01)

(52) U.S. Cl.
CPC ..... *F28D 15/0233* (2013.01); *F28D 15/0266* (2013.01); *F28D 15/046* (2013.01)

(56) References Cited

U.S. PATENT DOCUMENTS

| | | | | |
|---|---|---|---|---|
| 7,457,118 | B1 * | 11/2008 | French | H05K 7/20936 361/700 |
| 7,518,861 | B2 * | 4/2009 | Lev | G06F 1/203 165/104.33 |
| 7,551,443 | B2 * | 6/2009 | Liu | H01L 23/427 165/104.26 |
| 2012/0186787 | A1 | 7/2012 | Dinh | |

FOREIGN PATENT DOCUMENTS

| | | | |
|---|---|---|---|
| CN | 104654655 | A | 5/2015 |
| CN | 204612224 | U | 9/2015 |
| JP | H11-257882 | A | 9/1999 |

* cited by examiner

SINTERED HEAT TUBE AND SEMICONDUCTOR COOLING REFRIGERATOR PROVIDED WITH SAME

CROSS REFERENCE TO RELATED APPLICATIONS

The present application is a 35 U.S.C. § 371 National Phase conversion of International (PCT) Patent Application No. PCT/CN2015/091096, filed on Sep. 29, 2015, which claims the priority of the Chinese patent application No. 201510056261.X filed on Feb. 3, 2015 and with the title of "Sintered Heat Tube and Semiconductor Cooling Refrigerator Provided with Same", which is incorporated herein in its entirety as reference. The PCT International Patent Application was filed and published in Chinese.

TECHNICAL FIELD

The present invention is related to a sintered heat tube, and more particularly, to a sintered heat tube and a semiconductor cooling refrigerator provided with same.

BACKGROUND

A sintered heat tube is a highly efficient heat transfer element that transfers heat using phase change processes between evaporation and condensation of a liquid in a closed vacuum tube. The sintered heat tube has good heat transfer performance and isothermality, and includes a tube housing, a liquid absorption core and end caps. After evacuating the air in the tube to form a negative pressure of $1.3*(10^{-1}-10^{-4})$ Pa therein, a work liquid of a suitable amount is filled in the tube. After the capillary porous material of the liquid absorption core that presses closely against the inner wall of the tube is filled with the work liquid, the tube is sealed. One end of the sintered heat tube is an evaporating segment (or a heating segment), and the other end thereof is a condensing segment (or a cooling segment), and a heat insulating segment may be arranged between the evaporating and condensing segments according to the application needs. When one end of the sintered heat tube is heated, the liquid in the capillary core is evaporated and vaporized. The vapors flow to the other end of the tube due to a slight pressure difference, emit heat and condense into liquid again. Then, the liquid flows to the evaporating segment again under the capillary force along the porous material. This process cycles endlessly, transferring the heat from one end to the other end of the sintered heat tube. In other words, an existing sintered heat tube extends from its one end to the other along an exclusive path, which may be linear, L-shaped or U-shaped. However, existing sintered heat tubes may not achieve desired effects when radiating heat for heat sources of a high heat flow density such as semiconductor cooling plates.

SUMMARY

One object of a first aspect of the present invention is to overcome at least one defect of an existing sintered heat tube by providing a novel sintered heat tube.

A further object of the first aspect of the present invention is to improve the heat radiating or cold transferring efficiency of the sintered heat tube as much as possible.

A yet further object of the first aspect of the present invention is to make the structure of the sintered heat tube compact.

One object of a second aspect of the present invention is to provide a semiconductor cooling refrigerator having the above sintered heat tube.

The first aspect of the present invention provides a sintered heat tube, which may comprise: a main tube segment with its both ends closed; and a manifold tube segment/manifold tube segments extending from one or more portions of one side of the main tube segment (respectively), wherein a work chamber of each manifold tube segment communicates with that of the main tube segment.

Optionally, a liquid absorption core of each manifold tube segment communicates with that of the main tube segment.

Optionally, an axis of the main tube segment is a space curve, or a straight line, an L-shaped line or a U-shaped line.

Optionally, each manifold tube segment extends outwards and perpendicularly to the main tube segment from a corresponding portion of the main tube segment.

Optionally, there are at least 3 manifold tube segments whose starting ends are arranged at equal intervals on the main tube segment along the extension direction of the main tube segment.

Optionally, an axis of the main tube segment is a straight line, and a starting end of each manifold tube segment is located at an intermediate portion of the main tube segment.

Optionally, the main tube segment comprises a first straight tube portion, and a second straight tube portion which extends from one end of the first straight tube portion and perpendicularly thereto and whose tip end is closed, wherein a starting end of each manifold tube segment is located on the first straight tube portion, and a projection of each manifold tube segment in a plane perpendicular to the first straight tube portion overlaps with that of the second straight tube portion in the plane.

Optionally, the main tube segment further comprises a third straight tube portion whose one end is closed and which is arranged to be parallel with the first straight tube portion, and a connecting straight tube portion connected between the first and third straight tube portions with an angle between 100 degrees and 170 degrees relative to the first and third straight tube portions respectively, wherein the first, third and connecting straight tube portions are located in the same plane which is perpendicular to the second straight tube portion.

Optionally, a diameter of each manifold tube segment is equal to that of the main tube segment.

The second aspect of the present invention provides a semiconductor cooling refrigerator, comprising an inner tank, a semiconductor cooling plate and a heat exchanger. In particular, the heat exchanger comprises multiple sintered heat tubes of any of the above types, wherein a part or all of the main tube segment of each sintered heat tube is thermally connected to a hot or cold end of the semiconductor cooling plate, and the manifold tube segment of each sintered heat tube is configured to radiate heat to ambient air or to transfer cold to a storage compartment of the inner tank.

In the sintered heat tube and the semiconductor cooling refrigerator having the sintered heat tube of the present invention, as the sintered heat tube includes manifold tube segments, its structure is remarkably different from a traditional one which extends along an exclusive path, and the sintered heat tube of the present invention greatly improves the heat radiating or cold transferring efficiency.

Further, in the sintered heat tube and the semiconductor cooling refrigerator having the sintered heat tube of the present invention, the novel sintered heat tube is particularly suitable for heat radiation of heat sources of a high heat flow density such as semiconductor cooling plates.

The above and other objects, advantages and features of the present invention will be understood by those skilled in the art more clearly with reference to the detailed description of the embodiments of the present below with reference to the accompanied drawings.

BRIEF DESCRIPTION OF THE DRAWINGS

The followings will describe some embodiments of the present invention in detail in an exemplary rather than a restrictive manner with reference to the accompanying drawings. The same reference signs in the drawings represent the same or similar parts. Those skilled in the art shall understand that these drawings are only schematic ones of the present invention, and may not be necessarily drawn according to the scales. In the drawings.

DETAILED DESCRIPTION

Figure 1:
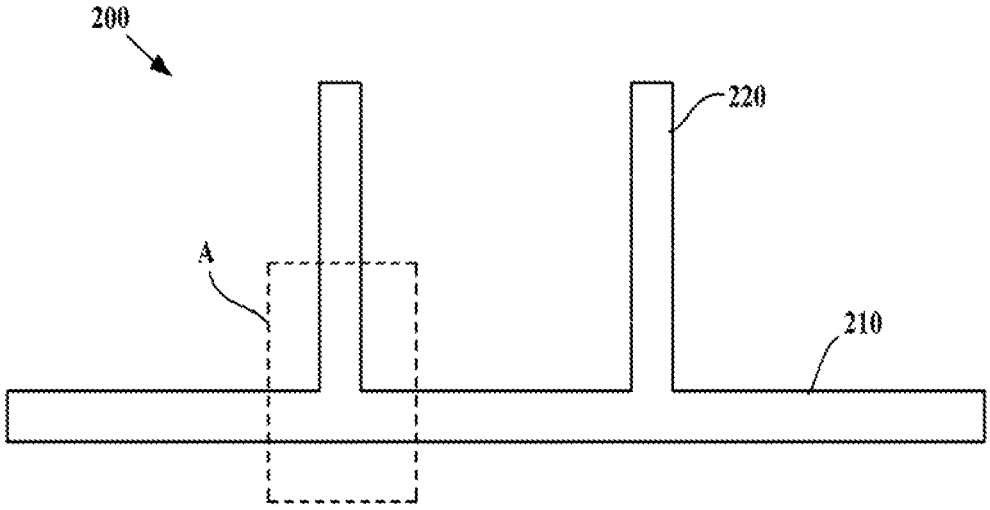
FIG. 1 is a schematic view of a sintered heat tube according to an embodiment of the present invention.
Figure 2:
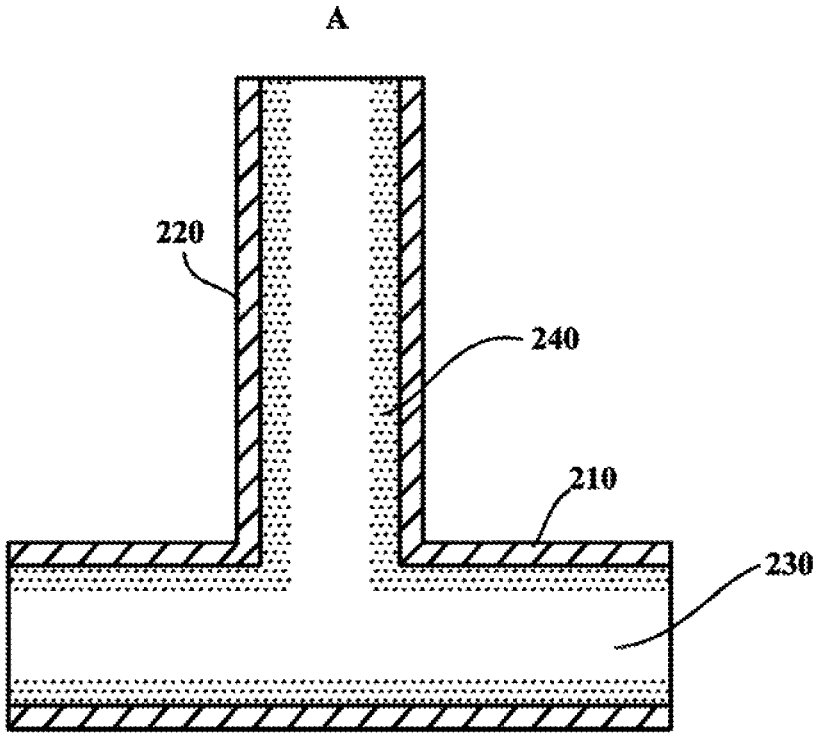
FIG. 2 is a local schematic sectional view of part A in FIG. 1.

FIG. 1 is a schematic view of a sintered heat tube according to an embodiment of the present invention. As shown in FIGS. 1-2, the embodiment of the present invention provides a novel sintered heat tube 200, which has relatively high heat radiating or cold transferring efficiency and may be applied in various heat exchangers, and particularly in heat sources of a high heat flow density such as semiconductor cooling plates 150. Specifically, the sintered heat tube 200 may include a main tube segment 210 with its both ends closed. In particular, a manifold tube segment/manifold tube segments 220 extend(s) from one or more portions of one side of the main tube segment 210 (respectively) to improve the heat radiating or cold transferring efficiency of the sintered heat tube 200. A work chamber 230 of each manifold tube segment 220 may communicate with a work chamber 230 of the main tube segment 210 to facilitate vapor flow in the sintered heat tube 200. Multiple manifold tube segments 220 of the sintered heat tube 200 may be located at the same side of the main tube segment 210 to make the structure of the sintered heat tube 200 more compact.

In some embodiments of the present invention, as shown in FIG. 2, a liquid absorption core 240 of each manifold tube segment 220 communicates with a liquid absorption core 240 of the main tube segment 210. The liquid absorption cores 240 of each manifold tube segment 220 and of the main tube segment 210 press closely against the inner wall of the corresponding tubes to facilitate flow of the work liquid. Further, a diameter of each manifold tube segment 220 may be equal to that of the main tube segment 210. In some alternative embodiments of the present invention, the diameter of each manifold tube segment 220 may be less than that of the main tube segment 210.

An axis of the main tube segment 210 may be a space curve to facilitate the arrangement of the sintered heat tube 200. As well known by those skilled in the art, the axis of the main tube segment 210 may be a plane curve, such as a straight line, an L-shaped line or a U-shaped line. Each manifold tube segment 220 extends outwards and perpendicularly to the main tube segment 210 from a corresponding portion of the main tube segment 210.

Figure 3:
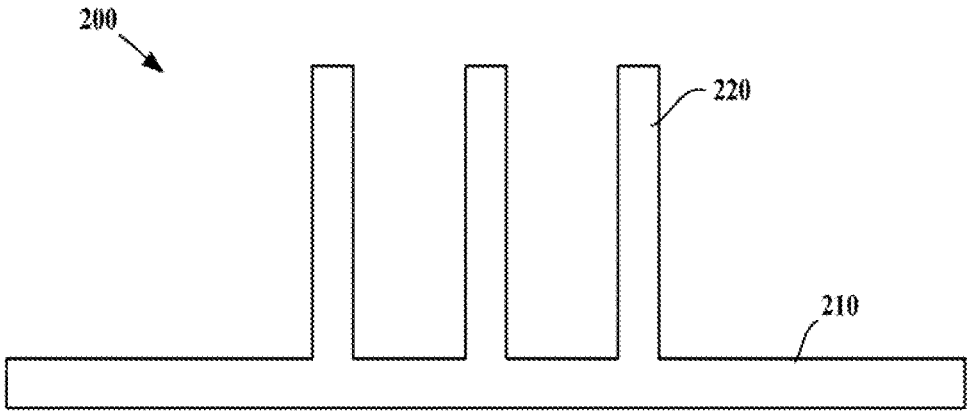
FIG. 3 is a schematic view of a sintered heat tube according to another embodiment of the present invention.

FIG. 3 is a schematic view of a sintered heat tube 200 according to another embodiment of the present invention. In the embodiments of the present invention, an axis of the main tube segment 210 of the sintered heat tube 200 is a straight line. A starting end of each manifold tube segment 220 is located at an intermediate portion of the main tube segment 210. When radiating heat or transferring cold, one side of the intermediate portion of the main tube segment 210 of the sintered heat tube 200, on whose opposite side the manifold tube segment 220 is arranged, may be pressed closely against the heat or cold source. Each manifold tube segment 220 and both ends of the main tube segment 210 may be used to radiate heat or transfer cold. There are at least 3 manifold tube segments 220 whose starting ends are arranged at equal intervals on the main tube segment 210 along the extension direction of the main tube segment 210.

Figure 4:
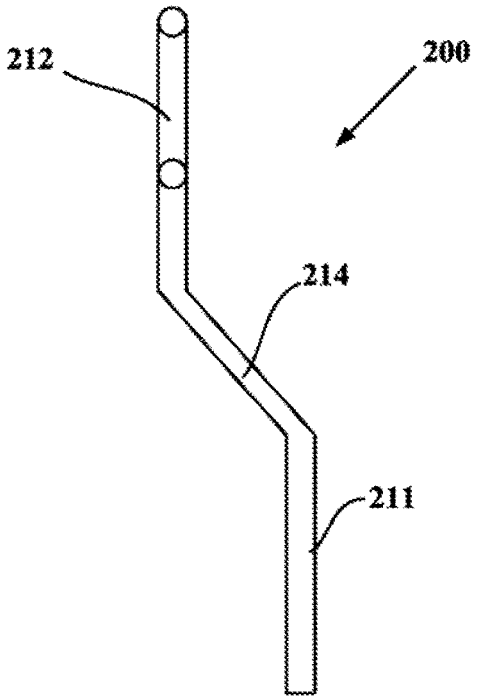
FIG. 4 is a schematic front view of a sintered heat tube according to yet another embodiment of the present invention.
Figure 5:
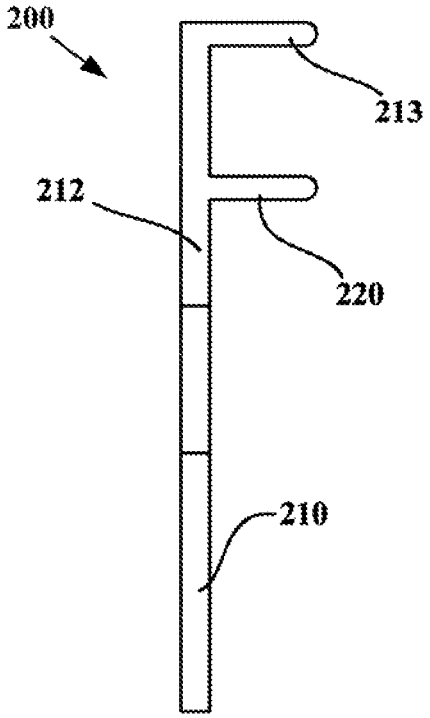
FIG. 5 is a schematic left view of the sintered heat tube shown in FIG. 4.

FIG. 4 is a schematic front view of a sintered heat tube 200 according to yet another embodiment of the present invention. As shown in FIGS. 4-5, the main tube segment 210 of the sintered heat tube 200 in the embodiments of the present invention may comprise a first straight tube portion 212, and a second straight tube portion 213 which extends from one end of the first straight tube portion 212 and perpendicularly thereto and whose tip end is closed. Particularly, a starting end of each manifold tube segment 220 is located on the first straight tube portion 212. Preferably, a projection of each manifold tube segment 220 in a plane perpendicular to the first straight tube portion 212 overlaps with that of the second straight tube portion 213 in the plane. Those skilled in the art may understand that in the embodiments of the present invention, when one side of the first straight tube portion 212 of the main tube segment 210 includes a manifold tube segment 220, the second straight tube portion 213 of the main tube segment 210 may be understood as a manifold tube segment 220 extending from a tip end of the main tube segment 210.

In the embodiments of the present invention, the sintered heat tube 200 further comprises a third straight tube portion 211 whose one end is closed and a connecting straight tube portion 214 connected between the first and third straight tube portions 212, 211. The third straight tube portion 211 is arranged to be parallel with the first straight tube portion 212. The connecting straight tube portion 214 is arranged at an angle between 100 degrees and 170 degrees relative to the first and third straight tube portions 212, 211 respectively. Preferably, the first, third and connecting straight tube portions 212, 211, 214 are located in the same plane which is perpendicular to the second straight tube portion 213. The third straight tube portion 211 may be thermally connected to a heat or cold source. The first and second straight tube portions 212, 213 and the manifold tube segments 220 may be used to radiate heat or transfer cold. In some alternative embodiments of the present invention, the sintered heat tube 200 may only include the first straight tube portion 212, the connecting straight tube portion 214 and the third straight tube portion 211. The starting end of each manifold tube segments 220 is located at the first straight tube portion 212.

Figure 6:
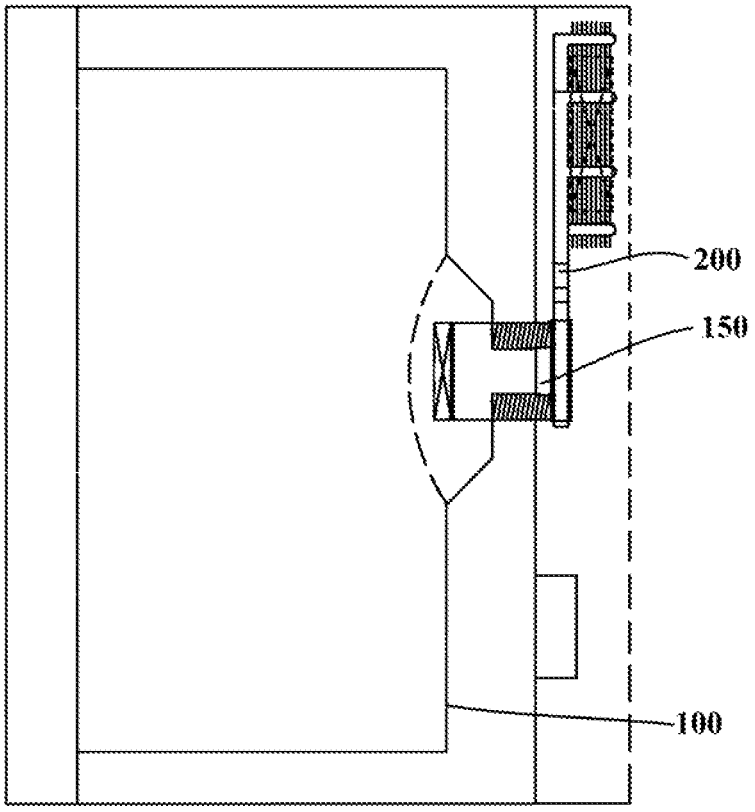
FIG. 6 is a schematic right view of a semiconductor cooling refrigerator according to an embodiment of the present invention.
Figure 7:
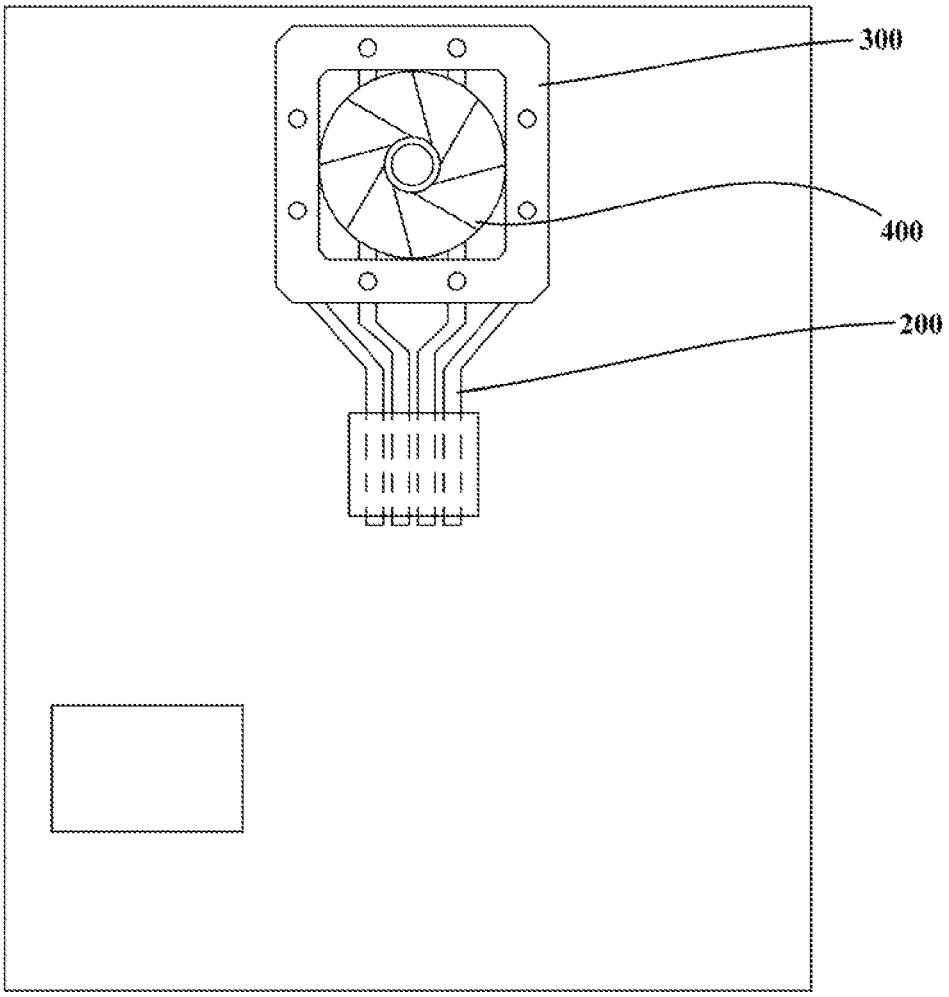
FIG. 7 is a schematic rear view of a semiconductor cooling refrigerator according to another embodiment of the present invention.

FIG. 6 is a schematic right view of a semiconductor refrigerator according to an embodiment of the present invention. As shown in FIGS. 6-7, the embodiments of the present invention further provide a semiconductor cooling refrigerator comprising an inner tank 100, a semiconductor cooling plate 150 and a heat exchanger. The heat exchanger is configured to radiate heat from a hot end of the semiconductor cooling plate 150 to ambient air or to transfer cold from a cold end thereof to a storage compartment of the inner tank 100. In particular, the heat exchanger may comprise multiple sintered heat tubes 200 of any type described in the above embodiments, wherein a part or all of the main tube segment 210 of each sintered heat tube 200 is thermally connected to a hot or cold end of the semiconductor cooling plate 150, and the manifold tube segment 220 of each sintered heat tube 200 is configured to radiate heat to the ambient air or to transfer cold to the storage compartment. In the embodiments shown in FIGS. 6-7, the heat exchanger is used to radiate heat for the hot end of the semiconductor cooling plate 150.

To improve the heat radiating or cold transferring efficiency, the manifold tube segment 220 of each sintered heat tube 200 may be mounted with heat radiating fins 300. The heat exchanger may include a blower. In particular, each fin 300 has receiving through holes at its middle portion, so that multiple fins 300 define a receiving space extending along the axes of the receiving through holes. The blower may be a centrifugal fan 400, which may arranged in the receiving space and is configured such that an air inlet area of the blower sucks air flow and the air flow is blown to a gap between each two adjacent fins 300. In some alternative embodiments of the present invention, the blower may be an axial blower, may be arranged at the same side of multiple manifold tube segments 220, and may be configured such that an air inlet area of the blower sucks air flow and the air flow is blown to a gap between each two adjacent fins 300, or the air flow is sucked from the gap between each two adjacent fins 300 and is then blown to the air inlet area.

Although multiple embodiments of the present invention have been illustrated and described in detail, those skilled in the art may make various modifications and variations to the invention based on the content disclosed by the present invention or the content derived therefrom without departing from the spirit and scope of the invention. Thus, the scope of the present invention should be understood and deemed to include these and other modifications and variations.

The invention claimed is:

1. A heat tube, comprising: a main tube segment having closed ends; and at least one manifold tube segment extending from one or more portions of one side of the main tube segment, wherein a work chamber of each of said at least one manifold tube segment communicates with that of the main tube segment and a work liquid flowing in the work chamber of the each of said at least one manifold tube segment and the work chamber of the main tube segment;

wherein the main tube segment comprises a first straight tube portion, and a second straight tube portion which extends from one end of the first straight tube portion and perpendicularly thereto and having a closed tip end;

a starting end of the each of said at least one manifold tube segment is located on the first straight tube portion;

a projection of the each of said at least one manifold tube segment in a plane perpendicular to the first straight tube portion overlaps with that of the second straight tube portion in the plane;

wherein the main tube segment further comprises:

a third straight tube portion having a closed tip end and which is arranged to be parallel with the first straight tube portion; and a connecting straight tube portion connected between the first and third straight tube portions with an angle between 100 degrees and 170 degrees relative to the first and third straight tube portions respectively;

wherein the first, third and connecting straight tube portions are located in a same plane which is perpendicular to the second straight tube portion.

2. The heat tube of claim 1, wherein a liquid absorption core of the each of said at least one manifold tube segment communicates with that of the main tube segment.

3. The heat tube of claim 1, wherein a tube axis of the main tube segment is a space curve.

4. The heat tube of claim 1, wherein the each of said at least one manifold tube segment extends outwards and perpendicularly to the main tube segment from a corresponding portion of the main tube segment.

5. The heat tube of claim 1, wherein a diameter of the each of at least one manifold tube segment is equal to that of the main tube segment.

6. A semiconductor cooling refrigerator, comprising an inner tank, a semiconductor cooling plate and a heat exchanger, wherein the heat exchanger comprises multiple heat tubes, each heat tube comprises: a main tube segment having closed ends; and at least one manifold tube segment extending from one or more portions of one side of the main tube segment, wherein a work chamber of each of said at least one manifold tube segment communicates with that of the main tube segment and a work liquid flowing in the work chamber of the each of said at least one manifold tube segment and the work chamber of the main tube segment;

a part or all of the main tube segment of the each heat tube is thermally connected to a hot or cold end of the semiconductor cooling plate; and the each of said at least one manifold tube segment of the each heat tube is configured to radiate heat to ambient air or to transfer cold to a storage compartment of the inner tank;

wherein the main tube segment comprises a first straight tube portion, and a second straight tube portion which extends from one end of the first straight tube portion and perpendicularly thereto and having a closed tip end;

a starting end of the each of said at least one manifold tube segment is located on the first straight tube portion;

a projection of the each of said at least one manifold tube segment in a plane perpendicular to the first straight tube portion overlaps with that of the second straight tube portion in the plane;

wherein the main tube segment further comprises:

a third straight tube portion having a closed tip end and which is arranged to be parallel with the first straight tube portion; and a connecting straight tube portion connected between the first and third straight tube portions with an angle between 100 degrees and 170 degrees relative to the first and third straight tube portions respectively;

wherein the first, third and connecting straight tube portions are located in a same plane which is perpendicular to the second straight tube portion.

7. The semiconductor cooling refrigerator of claim 6, wherein a liquid absorption core of the each of said at least one manifold tube segment communicates with that of the main tube segment.

8. The semiconductor cooling refrigerator of claim 6, wherein a tube axis of the main tube segment is a space curve.

9. The semiconductor cooling refrigerator of claim 6, wherein the each of said at least one manifold tube segment extends outwards and perpendicularly to the main tube segment from a corresponding portion of the main tube segment.

10. The semiconductor cooling refrigerator of claim 6, wherein a diameter of the each of said at least one manifold tube segment is equal to that of the main tube segment.

* * * * *